US012668854B2

(12) United States Patent
Knesel

(10) Patent No.: US 12,668,854 B2
(45) Date of Patent: Jun. 30, 2026

(54) MATERIALS AND METHODS FOR INCREASING GOLD RECOVERY FROM LEACHATE SOLUTIONS

(71) Applicant: LOCUS SOLUTIONS IPCO, LLC, Solon, OH (US)

(72) Inventor: Gabriela Knesel, Solon, OH (US)

(73) Assignee: LOCUS SOLUTIONS IPCO, LLC, Solon, OH (US)

( * ) Notice: Subject to any disclaimer, the term of this patent is extended or adjusted under 35 U.S.C. 154(b) by 0 days.

(21) Appl. No.: 18/252,455

(22) PCT Filed: Apr. 19, 2023

(86) PCT No.: PCT/US2023/065943
§ 371 (c)(1),
(2) Date: May 10, 2023

(87) PCT Pub. No.: WO2023/205684
PCT Pub. Date: Oct. 26, 2023

(65) Prior Publication Data

US 2025/0043387 A1 Feb. 6, 2025

Related U.S. Application Data

(60) Provisional application No. 63/333,295, filed on Apr. 21, 2022.

(51) Int. Cl.
*C22B 11/00* (2006.01)
*C22B 1/24* (2006.01)
*C22B 3/18* (2006.01)

(52) U.S. Cl.
CPC ..... *C22B 11/04* (2013.01); *C22B 1/24* (2013.01); *C22B 3/18* (2013.01)

(58) Field of Classification Search
CPC ..... B01D 11/0288; B03D 1/004; B03D 2203/025; C22B 1/00; C22B 1/24; C22B 11/04; C22B 11/08; C22B 3/18
See application file for complete search history.

(56) References Cited

U.S. PATENT DOCUMENTS

| | | | | |
|---|---|---|---|---|
| 4,981,582 | A | 1/1991 | Yoon et al. | |
| 5,021,088 | A * | 6/1991 | Portier | C22B 3/18 75/736 |
| 5,127,942 | A | 7/1992 | Brierley et al. | |
| 5,167,375 | A | 12/1992 | Datta | |
| 5,338,338 | A | 8/1994 | Kohr | |
| 5,800,593 | A | 9/1998 | Kohr | |
| 7,992,718 | B1 | 8/2011 | Klunder | |
| 8,944,164 | B2 | 2/2015 | Veldman et al. | |
| 2002/0037245 | A1 | 3/2002 | Galina | |
| 2008/0269357 | A1 | 10/2008 | Sotillo | |
| 2014/0096437 | A1 | 4/2014 | Crowell et al. | |
| 2015/0275328 | A1 | 10/2015 | Walder et al. | |
| 2017/0056851 | A1 | 3/2017 | Nagano et al. | |
| 2019/0255372 | A1 | 8/2019 | Woodward | |
| 2020/0340076 | A1 * | 10/2020 | Farmer | C22B 15/0065 |
| 2022/0055042 | A1 | 2/2022 | Farmer et al. | |
| 2023/0322556 | A1 | 10/2023 | Farmer et al. | |

FOREIGN PATENT DOCUMENTS

| | | | |
|---|---|---|---|
| CN | 103088222 | A | 5/2013 |
| CN | 105567580 | A | 5/2016 |
| CN | 111214852 | A | 6/2020 |
| CN | 114470885 | A | 5/2022 |
| EP | 3332042 | B1 | 11/2020 |
| JP | 2013155416 | A | 8/2013 |
| KR | 20120016995 | A | 2/2012 |
| WO | 2016022113 | A1 | 2/2016 |
| WO | 2017044953 | A1 | 3/2017 |
| WO | 2018049182 | A2 | 3/2018 |
| WO | 2018107162 | A1 | 6/2018 |
| WO | 2018129299 | A1 | 7/2018 |
| WO | 2018148656 | A1 | 8/2018 |
| WO | 2018191172 | A1 | 10/2018 |
| WO | 2018231791 | A1 | 12/2018 |
| WO | 2018237137 | A1 | 12/2018 |
| WO | 2019133554 | A1 | 7/2019 |
| WO | 2019191296 | A1 | 10/2019 |
| WO | 2019204715 | A1 | 10/2019 |
| WO | 2019213055 | A1 | 11/2019 |
| WO | 2020069177 | A1 | 4/2020 |
| WO | 2020086405 | A1 | 4/2020 |
| WO | 2020264071 | A1 | 12/2020 |
| WO | 2020264073 | A1 | 12/2020 |
| WO | 2021183526 | A1 | 9/2021 |
| WO | 2021189049 | A1 | 9/2021 |

OTHER PUBLICATIONS

Oliveira, M. et al. "Review: sophorolipids a promising biosurfactant and it's applications." 2015. International journal of advanced biotechnology and research. 6. 2. p. 161-174 (Year: 2015).*

Brandl, H., "8 Microbial Leaching of Metals." Biotechnology, 10.9941979 (2001): pp. 191-224.

Camargo, F. P., et al., "Characterization of biosurfactant from yeast using residual soybean oil under acidic conditions and their use in metal removal processes." FEMS Microbiology Letters, 365.10 (2018): pp. 1-8.

Castelein, M., et al., "Bioleaching of metals from secondary materials using glycolipid biosurfactants." Minerals Engineering, 163 (2021): 106665, pp. 1-11.

(Continued)

*Primary Examiner* — Nicholas A Wang

(74) *Attorney, Agent, or Firm* — BENESCH, FRIEDLANDER, COPLAN & ARONOFF

(57) ABSTRACT

The subject invention provides safe, environmentally-friendly compositions and efficient methods for extracting impurities from gold ore. More specifically, the subject invention provides compositions derived from microorganisms for pre-leaching treatments of gold ore, which can be used for reducing carbonaceous material in gold ore.

17 Claims, No Drawings

(56) References Cited

OTHER PUBLICATIONS

De Brito, D. A., "Biosurfactants from renewable raw materials." Master's thesis, Universidade do Minho (Portugal), 2013, pp. 1-93.
De Oliveira, M. R., et al., "Review: Sophorolipids a Promising Biosurfactant and it's Applications." International Journal of Advanced Biotechnology and Research, vol. 6, Issue 2 (2015): pp. 161-174.
Dhar, P., et al., "Toward green flotation: Interaction of a sophorolipid biosurfactant with a copper sulfide." Journal of Colloid and Interface Science, 585 (2021): pp. 386-399.
Diaz, M. A., et al., "Metal Removal from Contaminated Soils Through Bioleaching Oxidizing Bacteria and Rhamnolipid Biosurfactants." Soil and Sediment Contamination: An International Journal, 24.1 (2015): pp. 16-29.
Ines, M., et al., "Glycolipids biosurfactants; potential related biomedical and biotechnological applications." Carbohydrate Research, 416 (2015): pp. 1-46.
Karwowska, E., "Bioleaching of metals from printed circuit boards supported with surfactant-producing bacteria." Journal of Hazardous Materials, 264 (2014): pp. 203-210.
Krebs, W., et al., "Microbial recovery of metals from solids." FEMS Microbiology Reviews, 20.3-4 (1997): pp. 605-617.
Lee, J., et al., "Bio-processing of solid wastes and secondary resources for metal extraction—A review." Waste Management, 32.1 (2012): pp. 3-18.
Liang, X., et al., "Metal and metalloid biorecovery using fungi." Microbial Biotechnology, 10.5 (2017): pp. 1199-1205.
"Carbon-neutral biosurfactants may help boost mineral extraction from low-grade ores." Retrieved from: https://www.mining.com/carbonneutral-biosurfactants-may-help-boost-mineral-extraction-from-low-grade-ores/ (Mar. 17, 2022): 1-2.
Pacwa-Plociniczak, M., et al., "Environmental Applications of Boisurfactants: Recent Advances." International Journal of Molecular Sciences, 12.1 (2011): pp. 633-654.
Sarubbo, L.A., et al., "Some aspects of heavy metals contamination remediation and role of biosurfactants." Chemistry and Ecology, 31.8 (2015): pp. 707-723.
Singh, S., et al., "A direct method for the preparation of glycolipid-metal nanoparticle conjugates: sophorolipids as reducing and capping agents for the synthesis of water re-dispersible silver nanoparticles and their antibacterial activity." New Journal of Chemistry, 33.3 (2009): pp. 646-652.
Valix, M., et al., "Fungal Bio-Leaching of Low Grade Laterite Ores." Minerals Engineering, 14.2 (2001): pp. 197-203.
Winterburn, J. B., et al., "Foam mitigation and exploitation in biosurfactant production." Biotechnology Letters, 34 (2012): pp. 187-195.
Wu, H., et al., "Metal extraction from municipal solid waste (MSW) incinerator fly ash-Chemical leaching and fungal bioleaching." Enzyme and Microbial Technology, 38.6 (2006): pp. 839-847.
Mubarok, M. Z., et al. "Improving gold recovery from refractory gold ores through biooxidation using iron-sulfur-oxidizing/sulfur-oxidizing mixotrophic bacteria." Hydrometallurgy 168 (2017): 69-75.

* cited by examiner

MATERIALS AND METHODS FOR INCREASING GOLD RECOVERY FROM LEACHATE SOLUTIONS

CROSS REFERENCE TO RELATED APPLICATION

This application is a National Stage Application of International Application No. PCT/US2023/065943, filed Apr. 19, 2023; which claims priority to U.S. Provisional Patent Application No. 63/333,295, filed Apr. 21, 2022, both of which are incorporated by reference herein in their entirety.

BACKGROUND OF THE INVENTION

Gold ore is an essential raw material for manufacturing electronics, heat shielding, jewelry, financial exchange, and in various medical and dental applications. Gold ores are often characterized based on mineralogical factors, including gold particle size, association with other minerals, coatings and rimmings, presence of cyanicides, oxygen consumers and preg-robbers, presence of refractory gold minerals, and locking of submicroscopic gold in sulfide mineral structure and include placers, quartz vein-lode ores, oxidized ores, silver-rich ores, copper sulfide ores, iron sulfide ores, arsenic sulfide ores, antimony sulfide ores, bismuth sulfide ores, telluride ores, and carbonaceous-sulfidic ores. Additionally, gold ores can be characterized into two groups: free-milling gold ores are gold ores in which the gold can be separated from impurities without chemical treatments or pressure leaching using standard cyanidation, while refractory gold ores require additional chemicals or a pre-treatment process before cyanidation treatments.

When gold is brought out of the ground, it is often naturally associated with unwanted carbonaceous material, sulfide minerals, and siliceous minerals. Carbonaceous materials, sulfide minerals, and siliceous minerals can be partially removed from the gold through pretreatment processes, such as, for example, oxidation of the sulfur or carbon using high temperature (e.g., roasting), bio-oxidation in which organisms and/or enzymes synthesized by said organisms promote oxidation reaction, or pressure. Additionally, physical grinding of the ores can be used alone or in conjunction with an oxidation process (e.g., Albion process).

The presence of carbonaceous matter, sulfide minerals, and siliceous minerals, which have the ability to adsorb, or preg-rob, gold from the cyanide leach solution used in gold cyanidation, can be responsible for poor recoveries. Gold cyanidation is a process that typically involves converting the gold to a water-soluble coordination complex using aqueous cyanide. The carbonaceous materials within the ore competes with activated carbon used during the leaching and adsorption phase of processing.

Currently, various approaches exist for mitigating this problem, including, for example, removal of the carbonaceous material (e.g., flotation), addition of materials that bind to the surface of the carbonaceous material, and addition of strong adsorbents to compete with the carbonaceous material. Safe and efficient recovery of gold from ore is important. Therefore, novel, improved methods are needed for the processing of gold ore.

BRIEF SUMMARY OF THE INVENTION

The subject invention relates generally to the removal of impurities from gold ore. More specifically, the subject invention provides environmentally-friendly compositions and methods for extracting impurities, such as, for example, carbonaceous material, from gold ore. In certain embodiments, the impurities can be safely discarded using methods known in the art, while in other embodiments, the impurities can be recycled and/or processed for other uses.

Advantageously, the compositions and methods of the subject invention increase the efficiency of obtaining gold from gold ore and can decrease the chemical usage required for processing gold ore into useful products, such as electronics, heat shielding, and jewelry. Accordingly, the subject invention can be useful for reducing the ground and water pollution of processing mined gold ore by reducing the use of toxic chemicals.

In certain embodiments, the subject invention provides compositions comprising components that are derived from microorganisms. In certain embodiments, the composition comprises a microbial biosurfactant. In certain embodiments, the composition comprises biosurfactants, and, optionally, other compounds, such as, for example, surfactants, pine oils, xanthates, or any combination thereof.

In certain embodiments, the biosurfactant of the composition is utilized in crude form. The crude form can comprise, in addition to the biosurfactant, fermentation broth in which a biosurfactant-producing microorganism was cultivated, residual microbial cell matter or live or inactive microbial cells, residual nutrients, and/or other microbial growth by-products.

In some embodiments, the biosurfactant is utilized after being extracted from a fermentation broth and, optionally, purified.

The biosurfactant according to the subject invention can be a glycolipid (e.g., sophorolipids, rhamnolipids, cellobiose lipids, mannosylerythritol lipids and trehalose lipids), lipopeptide (e.g., surfactin, iturin, fengycin, arthrofactin, and lichenysin), flavolipid, phospholipid (e.g., cardiolipins), fatty acid ester compound, fatty acid ether compound, and/or high molecular weight polymers such as lipoproteins, lipopolysaccharide-protein complexes, and polysaccharide-protein-fatty acid complexes.

In certain specific embodiments, the biosurfactant is a sophorolipid (SLP), including linear SLP, lactonic SLP, acetylated SLP, de-acetylated SIP, salt-form SLP, esterified SLP derivatives, amino acid-SLP conjugates, and other SLP derivatives or isomers that exist in nature and/or are produced synthetically. In preferred embodiments, the SLP is a linear SLP or a derivatized linear SLP.

In certain embodiments, the surfactant of the pre-leaching composition is a detergent, wetting agent, emulsifier, foaming agent, and/or dispersant.

In certain embodiments, the pine oil of the pre-leaching composition comprises α-terpineol, terpene alcohols, terpene hydrocarbons, terpene ethers, terpene esters, or any combination thereof.

In certain embodiments, the xanthate of the pre-leaching composition is sodium ethyl xanthate, potassium ethyl xanthate, sodium isopropyl xanthate, sodium isobutyl xanthate, potassium amyl xanthate, or any combination thereof.

In certain embodiments, the subject invention provides a method for removing impurities from gold ore, wherein the method comprises the following steps: (i) obtaining the gold ore, said ore comprising gold and an impurity; (ii) contacting a pre-leaching composition according to the subject invention with the ore for a period of time to yield a mixture comprising treated gold and an impurity; and (iii) separating the impurity and pre-leaching composition with the gold from the mixture.

The method can be carried out in a heap leach pad, a column, or any other laboratory or industrial sized reactor.

In some embodiments, step (i) comprises grinding the gold ore into a fine powder. The particles in the powder can be less than about 10 mm, about 1 mm, about 100 μm, about 10 μm, about 1 μm, about 100 nm, about 10 nm, about 1 nm, or less in diameter.

In some embodiments, step (ii) comprises applying a pre-leaching composition comprising a biosurfactant and, optionally, other components, such as, for example, water, surfactants, pine oils, and xanthates, to the gold ore. In certain embodiments, air can be pumped into the mixture and the gold and biosurfactants can rise to the top of mixture, creating a gold froth. In some embodiments, the froth can be removed and tailings or other non-gold containing components can be removed from the mixture. Step (ii) can be repeated as many times as necessary to achieve a desired reduction in impurity content.

In some embodiments, step (iii) further comprises gold cyanidation.

In certain embodiments, the method comprises (a) obtaining the gold ore, said ore comprising gold and an impurity; (b) applying a pre-leaching composition according to the subject invention to the gold ore under agitation for a period of time to yield a mixture comprising treated gold and an impurity; (c) preparing a slurry of the gold ore in water and maintaining the slurry under agitation and air bubbling, thereby causing the formation of a froth comprising the treated gold ore and an aqueous layer comprising impurities; and (e) separating the treated gold from the aqueous layer.

In certain embodiments, the pre-leaching composition according to the subject invention is effective due to amphiphile-mediated penetration of the gold ore. In some embodiments, the sophorolipid or other biosurfactant serves as a vehicle for facilitating the transport of gold. For example, in some embodiments, a sophorolipid will form a micelle containing the gold, wherein the micelle is less than 100 nm, less than 50 nm, less than 25 nm, less than 15 nm or less than 10 nm in size. The small size and amphiphilic properties of the micelle allow for enhanced penetration into the ore so that greater contact can be made with gold therein.

In certain embodiments, the impurity is as a carbonaceous material. In certain preferred embodiments, the impurity is elemental carbon, hydrocarbons, or organic acids.

In certain embodiments, the methods of the subject invention result in at least a 25% reduction in impurities content, preferably at least a 50% reduction, after one treatment. In certain embodiments, the gold ore can be treated multiple times to further reduce the impurities content.

In one embodiment, the method comprises crushing, grinding or pulverizing the gold ore into smaller particles, for example, less than about 100 μm, about 10 μm, about 1 μm, about 500 nm, about 100 nm, about 50 nm, about 10 nm, about 5 nm, 1 nm, or less in diameter, prior to treating with the pre-leaching composition.

In some embodiments, the gold ore is obtained from an ore deposit in a raw form. This raw form can comprise additional material, or gangue material. In certain embodiments, the method can further comprise, after obtaining the gold ore, concurrent with the treatment by the subject pre-leaching compositions, and/or after treating the gold ore with the pre-leaching composition, subjecting the ore to one or more beneficiation processes. The one or more beneficiation processes can include, for example, comminution, scrubbing, washing, screening, flotation, and/or hydrocycloning.

Advantageously, in certain embodiments, the pre-leaching composition according to the subject invention can be effective at removing impurities from gold ore before gold cyanidation. Furthermore, the methods of the subject invention do not require complicated equipment or high energy consumption, and production of the composition can be performed on site, for example, at an ore mine or at a leaching site.

DETAILED DESCRIPTION

The subject invention relates generally to the removal of impurities from gold ore. More specifically, the subject invention provides environmentally-friendly compositions and methods for extracting carbonaceous impurities, such as, for example, elemental carbon, organic acids, and hydrocarbons, from gold ore. In certain embodiments, the carbonaceous impurities can be safely discarded using methods known in the art, while in other embodiments the carbonaceous impurities can be recycled and/or processed for other uses to reduce waste and pollution.

Advantageously, the compositions and methods of the subject invention increase the yield of processing gold ore into useful products, such as jewelry, heat shielding, and in electronics. Accordingly, the subject invention is useful for improving the efficiency of processing mined gold ore.

Selected Definitions

As used herein, "applying" a composition or product refers to contacting it with a target or site such that the composition or product can have an effect on that target or site. The effect can be due to, for example, microbial growth and/or the action of a biosurfactant or other microbial growth by-product.

As used herein, a "biofilm" is a complex aggregate of microorganisms, such as bacteria, yeast, or fungi, wherein the cells adhere to each other and/or to a surface using an extracellular matrix. The cells in biofilms are physiologically distinct from planktonic cells of the same organism, which are single cells that can float or swim in liquid medium.

As used herein, an "isolated" or "purified" nucleic acid molecule, polynucleotide, polypeptide, protein or organic compound such as a small molecule (e.g., those described below), is substantially free of other compounds, such as cellular material, with which it is associated in nature. A purified or isolated polynucleotide (ribonucleic acid (RNA) or deoxyribonucleic acid (DNA)) is free of the genes or sequences that flank it in its naturally-occurring state. A purified or isolated polypeptide is free of the amino acids or sequences that flank it in its naturally-occurring state. An isolated microbial strain means that the strain is removed from the environment in which it exists in nature. Thus, the isolated strain may exist as, for example, a biologically pure culture, or as spores (or other forms of the strain) in association with a carrier.

In certain embodiments, purified compounds are at least 60% by weight the compound of interest. Preferably, the preparation is at least 75%, more preferably at least 90%, and most preferably at least 98%, by weight the compound of interest. For example, a purified compound is one that is at least 80%, 85%, 90%, 91%, 92%, 93%, 94%, 95%, 98%, 99%, or 100% (w/w) of the desired compound by weight. Purity is measured by any appropriate standard method, for example, by column chromatography, thin layer chromatography, or high-performance liquid chromatography (HPLC) analysis.

A "metabolite" refers to any substance produced by metabolism or a substance necessary for taking part in a particular metabolic process. A metabolite can be an organic compound that is a starting material, an intermediate in, or an end product of metabolism. Examples of metabolites include, but are not limited to, enzymes, acids, solvents, alcohols, proteins, vitamins, minerals, microelements, amino acids, biopolymers and biosurfactants.

Ranges provided herein are understood to be shorthand for all of the values within the range. For example, a range of 1 to 20 is understood to include any number, combination of numbers, or sub-range from the group consisting 1, 2, 3, 4, 5, 6, 7, 8, 9, 10, 11, 12, 13, 14, 15, 16, 17, 18, 19 and 20, as well as all intervening decimal values between the aforementioned integers such as, for example, 1.1, 1.2, 1.3, 1.4, 1.5, 1.6, 1.7, 1.8, and 1.9. With respect to sub-ranges, "nested sub-ranges" that extend from either end point of the range are specifically contemplated. For example, a nested sub-range of an exemplary range of 1 to 50 may comprise 1 to 10, 1 to 20, 1 to 30, and 1 to 40 in one direction, or 50 to 40, 50 to 30, 50 to 20, and 50 to 10 in the other direction.

As used herein a "reduction" means a negative alteration, and an "increase" means a positive alteration, wherein the negative or positive alteration is at least 0.001%, 0.01%, 0.1%, 0.5%, 1%, 5%, 10%, 15%, 20%, 25%, 30%, 35%, 40%, 45%, 50%, 55%, 60%, 65%, 70%, 75%, 80%, 85%, 90%, 95% or 100%.

As used herein, "surfactant" means a compound that lowers the surface tension (or interfacial tension) between two liquids or between a liquid and a solid. Surfactants act as, e.g., detergents, wetting agents, emulsifiers, foaming agents, and/or dispersants. A "biosurfactant" is a surface-active substance produced by a living cell and/or using naturally-derived substrates.

Biosurfactants are a structurally diverse group of surface-active substances consisting of two parts: a polar (hydrophilic) moiety and non-polar (hydrophobic) group. Due to their amphiphilic structure, biosurfactants can, for example, increase the surface area of hydrophobic water-insoluble substances, increase the water bioavailability of such substances, and change the properties of bacterial cell surfaces. Biosurfactants can also reduce the interfacial tension between water and oil and, therefore, lower the hydrostatic pressure required to move entrapped liquid to overcome the capillary effect. Biosurfactants accumulate at interfaces, thus reducing interfacial tension and leading to the formation of aggregated micellar structures in solution. The formation of micelles provides a physical mechanism to mobilize, for example, oil in a moving aqueous phase.

The ability of biosurfactants to form pores and destabilize biological membranes also permits their use as antibacterial, antifungal, and hemolytic agents to, for example, control pests and/or microbial growth.

Typically, the hydrophilic group of a biosurfactant is a sugar (e.g., a mono-, di-, or polysaccharide) or a peptide, while the hydrophobic group is typically a fatty acid. Thus, there are countless potential variations of biosurfactant molecules based on, for example, type of sugar, number of sugars, size of peptides, which amino acids are present in the peptides, fatty acid length, saturation of fatty acids, additional acetylation, additional functional groups, esterification, polarity and charge of the molecule.

These variations lead to a group of molecules comprising a wide variety of classes, including, for example, glycolipids (e.g., sophorolipids, rhamnolipids, cellobiose lipids, mannosylerythritol lipids and trehalose lipids), lipopeptides (e.g., surfactin, iturin, fengycin, arthrofactin and lichenysin), flavolipids, phospholipids (e.g., cardiolipins), fatty acid ester compounds, and high molecular weight polymers such as lipoproteins, lipopolysaccharide-protein complexes, and polysaccharide-protein-fatty acid complexes. Each type of biosurfactant within each class can further comprise subtypes having further modified structures.

Like chemical surfactants, each biosurfactant molecule has its own HLB value depending on its structure; however, unlike production of chemical surfactants, which results in a single molecule with a single HLB value or range, one cycle of biosurfactant production typically results in a mixture of biosurfactant molecules (e.g., subtypes and isomers thereof).

The phrases "biosurfactant" and "biosurfactant molecule" include all forms, analogs, orthologs, isomers, and natural and/or anthropogenic modifications of any biosurfactant class (e.g., glycolipid) and/or subtype thereof (e.g., sophorolipid).

As used herein, the term "sophorolipid," "sophorolipid molecule," "SLP" or "SLP molecule" includes all forms, and isomers thereof, of SLP molecules, including, for example, acidic (linear) SLP (ASL) and lactonic SLP (LSL). Further included are mono-acetylated SLP, di-acetylated SLP, esterified SLP, SLP with varying hydrophobic chain lengths, cationic and/or anionic SLP with fatty acid-amino acid complexes attached, esterified SLP, SLP-metal complexes, SLP-salt derivatives (e.g., a sodium salt of a linear SLP), and other, including those that are and/or are not described within in this disclosure.

In preferred embodiments, the SLP molecules according to the subject invention are represented by General Formula (1) and/or General Formula (2), and are obtained as a collection of 30 or more types of structural homologues having different fatty acid chain lengths ($R^3$), and, in some instances, having an acetylation or protonation at $R^1$ and/or $R^2$.

(1)

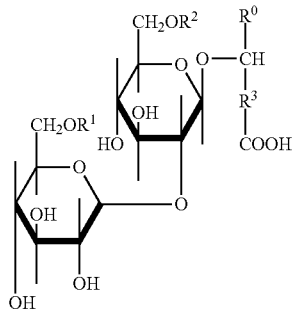

(2)

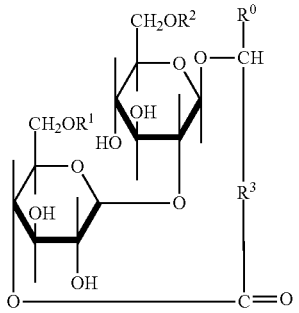

In General Formula (1) or (2), $R^0$ can be either a hydrogen atom or a methyl group. $R^1$ and $R^2$ are each independently a hydrogen atom or an acetyl group. $R^3$ is a saturated aliphatic hydrocarbon chain, or an unsaturated aliphatic hydrocarbon chain having at least one double bond, and may have one or more Substituents.

Examples of the Substituents include halogen atoms, hydroxyl, lower (C1-6) alkyl groups, halo lower (C1-6) alkyl groups, hydroxy lower (C1-6) alkyl groups, halo lower (C1-6) alkoxy groups, and others. $R^3$ typically has 11 to 20 carbon atoms. In certain embodiments of the subject invention, $R^3$ has 18 carbon atoms.

SLP are typically produced by yeasts, such as *Starmerella* spp. yeasts and/or *Candida* spp. yeasts, e.g., *Starmerella* (*Candida*) *bombicola, Candida apicola, Candida batistae, Candida floricola, Candida riodocensis, Candida stellate* and/or *Candida kuoi*. SLP have environmental compatibility, high biodegradability, low toxicity, high selectivity and specific activity in a broad range of temperature, pH and salinity conditions. Additionally, in some embodiments, SLP can be advantageous due to their small micelle size, which can help facilitate the movement of the micelle, and compounds enclosed therein, through nanoscale pores and spaces. In certain embodiments, the micelle size of a SLP is less than 100 nm, less than 50 nm, less than 20 nm, less than 15 nm, less than 10 nm, or less than 5 nm.

As used herein, "ore" refers to a naturally occurring solid material from which a valuable substance, mineral and/or metal can be profitably extracted. Ores are often mined from ore deposits, which comprise ore minerals containing the valuable substance. "Gangue" minerals are minerals that occur in the deposit but do not contain the valuable substance. Examples of ore deposits include hydrothermal deposits, magmatic deposits, laterite deposits, volcanogenic deposits, metamorphically reworked deposits, carbonatite-alkaline igneous related deposits, placer ore deposits, residual ore deposits, sedimentary deposits, sedimentary hydrothermal deposits and astrobleme-related deposits. Ores, as defined herein, however, can also include ore concentrates or tailings, gold, or even other sources of metal or valuable minerals, including but not limited to, jewelry, electronic scraps, and other scrap materials.

As used herein, "gold leaching" refers to the process by which gold is extracted from ore by aqueous solutions including by "cyanidation" or "thiosulfate leaching". As used herein "cyanidation" refers to the process of converting gold in ore to a water-soluble coordination complex using aqueous cyanide, including, for example, sodium cyanide, potassium cyanide, or calcium cyanide.

The transitional term "comprising," which is synonymous with "including," or "containing," is inclusive or open-ended and does not exclude additional, unrecited elements or method steps. By contrast, the transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention. Use of the term "comprising" contemplates other embodiments that "consist" or "consist essentially of" the recited component(s).

Unless specifically stated or obvious from context, as used herein, the term "or" is understood to be inclusive. Unless specifically stated or obvious from context, as used herein, the terms "a," "and" and "the" are understood to be singular or plural.

Unless specifically stated or obvious from context, as used herein, the term "about" is understood as within a range of normal tolerance in the art, for example within 2 standard deviations of the mean. About can be understood as within 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein are modified by the term about.

The recitation of a listing of chemical groups in any definition of a variable herein includes definitions of that variable as any single group or combination of listed groups. The recitation of an embodiment for a variable or aspect herein includes that embodiment as any single embodiment or in combination with any other embodiments or portions thereof.

All references cited herein are hereby incorporated by reference in their entirety.

Pre-Leaching Composition

In certain embodiments, the subject invention provides pre-leaching compositions comprising components that are derived from microorganisms. In certain embodiments, the pre-leaching composition comprises a microbial biosurfactant. In certain embodiments, the composition comprises a biosurfactant, and, optionally, surfactants, pine oils, xanthates, or any combination thereof.

In certain embodiments, the pre-leaching composition comprises a microbe-based product comprising a biosurfactant utilized in crude form. The crude form can comprise, in addition to the biosurfactant, fermentation broth in which a biosurfactant-producing microorganism was cultivated, residual microbial cell matter or live or inactive microbial cells, residual nutrients, and/or other microbial growth by-products. The product may be, for example, at least, by weight, 1%, 5%, 10%, 25%, 50%, 75%, or 100% broth. The amount of biomass in the product, by weight, may be, for example, anywhere from 0% to 100% inclusive of all percentages therebetween.

In some embodiments, the biosurfactant is utilized after being extracted from a fermentation broth and, optionally, purified.

The biosurfactant according to the subject invention can be a glycolipid (e.g., sophorolipids, rhamnolipids, cellobiose lipids, mannosylerythritol lipids and trehalose lipids), lipopeptide (e.g., surfactin, iturin, fengycin, arthrofactin and lichenysin), flavolipid, phospholipid (e.g., cardiolipins), fatty acid ester compound, fatty acid ether compound, and/or high molecular weight polymers such as lipoproteins, lipopolysaccharide-protein complexes, and polysaccharide-protein-fatty acid complexes.

In certain specific embodiments, the biosurfactant is a sophorolipid (SLP), including linear SLP, lactonic SLP, acetylated SLP, de-acetylated SLP, salt-form SLP derivatives, esterified SIP derivatives, amino acid-SLP conjugates, and other SLP derivatives or isomers that exist in nature and/or are produced synthetically. In preferred embodiments, the SLP is a linear SLP or a derivatized linear SLP. In certain embodiments, the subject compositions can comprise lactonic and linear SLP, with at least about 50%, about 55%, about 60%, about 65%, about 70%, about 75%, about 80%, about 85%, about 90%, or about 95% of the SLP comprising linear forms, and the remainder comprising lactonic forms.

In some embodiments, the biosurfactant can be included in the composition at 0.01 to 99.9%, 0.1 to 90%, 0.5 to 80%, 0.75 to 70%, 1.0 to 50%, 1.5 to 25%, or 2.0 to 15% by weight, with respect to the total pre-leaching composition.

In another embodiment, purified biosurfactants may be added in combination with an acceptable carrier, in that the biosurfactant may be presented at concentrations of 0.001 to 50% (v/v), preferably, 0.01 to 20% (v/v), more preferably, 0.02 to 5% (v/v).

In some embodiments, the biosurfactant can be included in the composition at, for example, 0.01 to 100,000 ppm, 0.05 to 10,000 ppm, 0.1 to 1,000 ppm, 0.5 to 750 ppm, 1.0 to 500 ppm, 2.0 to 250 ppm, or 3.0 to 100 ppm, with respect to the amount of gold ore being treated.

In certain embodiments, the chemical surfactant of the pre-leaching composition is a detergent, wetting agent, emulsifier, foaming agent, and/or dispersant. In some embodiments, the chemical surfactant can be included in the composition at 0.01 to 99.9%, 0.1 to 90%, 0.5 to 80%, 0.75 to 70%, 1.0 to 50%, 1.5 to 25%, or 2.0 to 15% by weight, with respect to the total pre-leaching composition.

In certain embodiments, the pine oil of the pre-leaching composition comprises α-terpincol, terpene alcohols, terpene hydrocarbons, terpene ethers, terpene esters, or any combination thereof. In some embodiments, the pine oil can be included in the composition at 0.01 to 99.9%, 0.1 to 90%, 0.5 to 80%, 0.75 to 70%, 1.0 to 50%, 1.5 to 25%, or 2.0 to 15% by weight, with respect to the total pre-leaching composition.

In certain embodiments, the xanthate of the pre-leaching composition is sodium ethyl xanthate, potassium ethyl xanthate, sodium isopropyl xanthate, sodium isobutyl xanthate, potassium amyl xanthate, or any combination thereof. In some embodiments, the xanthate can be included in the composition at 0.01 to 99.9%, 0.1 to 90%, 0.5 to 80%, 0.75 to 70%, 1.0 to 50%, 1.5 to 25%, or 2.0 to 15% by weight, with respect to the total pre-leaching composition.

The pre-leaching composition can further comprise other additives such as, for example, carriers, other microbe-based compositions, additional biosurfactants, enzymes, catalysts, solvents, salts, buffers, chelating agents, acids, emulsifying agents, lubricants, solubility controlling agents, preservatives, stabilizers, ultra-violet light resistant agents, viscosity modifiers, preservatives, tracking agents, biocides, and other microbes and other ingredients specific for an intended use.

Methods of Extracting Impurities from Gold Ore

In certain embodiments, the subject invention provides a method for extracting impurities from gold ore, including impurities selected from, for example, carbonaceous materials. In certain specific embodiments, the impurity is elemental carbon, hydrocarbons, or organic acids.

In certain embodiments, the subject invention provides a method for removing impurities from gold ore, wherein the method comprises the step of: (i) obtaining the gold ore, said ore comprising gold and an impurity; (ii) contacting a pre-leaching composition according to the subject invention with the ore for a period of time to yield a mixture comprising a treated gold ore and an impurity; and (iii) separating the impurity and pre-leaching composition with the gold from the mixture.

The method can be carried out in a heap leach pad, a column, or any other laboratory or industrial sized reactor.

In some embodiments, step (i) comprises grinding the obtained gold ore into a fine powder. The particles in the powder can be less than about 10 mm, about 1 mm, about 100 μm, about 10 μm, about 1 μm, about 100 nm, about 10 nm, about 1 nm, or less in diameter.

In some embodiments, step (ii) comprises applying a pre-leaching composition comprising a biosurfactant and, optionally, water, other surfactants, pine oils, and xanthates, to the gold ore. In certain embodiments, air can be pumped into the mixture and the gold and biosurfactants can rise to the top of mixture, creating a gold froth. In some embodiments, the froth can be removed and tailings or other non-gold containing components can be removed from the mixture. Step (ii) can be repeated as many times as necessary to achieve a desired reduction in impurity content.

In certain embodiments, the time period of step (ii) is from 1 minute to 48 hours, about 30 minutes to 40 hours, or preferably about 12 hours to 24 hours. In certain embodiments, step (ii) comprises applying a liquid form pre-leaching composition to the ore to produce a liquid mixture and stirring or otherwise agitating the liquid mixture for the period of time.

In some embodiments, when step (ii) is carried out in liquid, the impurity is present in the aqueous phase and the gold ore floats in a froth above the aqueous phase that can be removed from the liquid.

In some embodiments, step (iii) comprises applying a leaching solution comprising cyanide, such as, for example, sodium cyanide, and optionally, mixing under agitation (e.g., shaking or stirring) for a period of time (e.g., 10 hours to 48 hours). The leaching solution will comprise the impurity and pre-leaching composition, and the gold ore is contained within a coordination complex that is removed from the fluid. In some embodiments, step (iii) comprises gold cyanidation.

In certain embodiments, the method comprises (a) obtaining the gold ore, said ore comprising gold and an impurity; (b) applying a pre-leaching composition according to the subject invention to the gold ore under agitation for a period of time to yield a mixture comprising a treated gold ore and an impurity; (c) preparing a slurry of the gold ore in water and maintaining the slurry under agitation and air bubbling, thereby causing the formation of a froth comprising the treated gold ore and an aqueous layer comprising impurities; and (e) separating the treated gold from the aqueous layer.

In some embodiments, step (e) comprises applying a leaching solution to the mixture, optionally under agitation (e.g., shaking or stirring) for a period of time (e.g., about 10 hours to about 48 hours). The leaching solution will comprise the impurity and pre-leaching composition, and the gold ore is contained within a coordination complex that is removed from the fluid.

The methods of the subject invention can be carried out at ambient temperature, and/or at a temperature of about 15° C. to about 50° C., about 20° C. to about 40° C., about 20° C. to about 35° C., about 20° C. to about 30° C., about 25° C., about 40° C. to 120° C., about 50° C. to about 100° C., about 60° C. to about 100° C., about 70° C. to about 100° C., about 80° C. to about 100° C., or about 100° C. In certain embodiments, a temperature higher than ambient temperature can be provided using a microwave, ultrasound, induction heating, plasma, electricity, or any combination thereof.

The methods of the subject invention can be carried out at ambient pressure, and/or at a pressure of about 50 bars, 75 bar, 100 bars, or greater than 100 bars.

In certain embodiments, the amount of the pre-leaching composition applied is about 0.1 to 15%, about 0.1 to 10%, about 0.1 to 5%, about 0.1 to 3%, about 0.1%, or about 1 vol % based on an amount of the gold-containing material.

In certain embodiments, the methods of the subject invention result in at least 25% reduction in impurities content, preferably at least 50% reduction, after one treatment. In some embodiments, the gold ore can be treated multiple times to further reduce the impurities content.

In certain embodiments, the pre-leaching composition according to the subject invention is effective due to amphiphiles-mediated penetration of the gold ore. In some embodiments, the sophorolipid or other biosurfactant serves as a vehicle for facilitating the transport of gold. For example, in some embodiments, a sophorolipid will form a micelle containing the gold, wherein the micelle is less than 100 nm, less than 50 nm, less than 25 nm, less than 15 nm or less than 10 nm in size. The small size and amphiphilic properties of the micelle allow for enhanced penetration into the ore so that greater contact can be made with gold therein.

In one embodiment, the method comprises crushing, grinding or pulverizing the gold ore into smaller particles, for example, less than about 10 mm, about 1 mm, about 100 μm, about 10 μm, about 1 μm, about 500 nm, about 100 nm, about 50 nm, about 10 nm, about 5 nm, about 1 nm, or less in diameter, prior to treating with the pre-leaching composition.

In some embodiments, the gold ore is obtained from an ore deposit in a raw form. This raw form can comprise additional materials, or gangue. Thus, in certain embodiments, the method can further comprise, after obtaining the gold ore concurrent with the treatment with the subject pre-leaching compositions, and/or after treating the gold ore with the pre-leaching composition, subjecting the ore to one or more beneficiation processes. The one or more beneficiation processes can include, for example, comminution, scrubbing, washing, screening, flotation, and/or hydrocycloning. In certain embodiments, the subject compositions can be used in one or more beneficiation processes, such as, for example, flotation. The subject compositions can be added to compositions used for flotation. Additionally, the subject compositions can replace or reduce the use of one or more components of a composition used for flotation, such as, for example, a surfactant.

In some embodiments, the method comprises oxidizing the organic matter present in the gold ore using, for example, the pre-leaching composition and/or hydrogen peroxide, prior to contacting the gold ore with a leaching composition.

Advantageously, in certain embodiments, the pre-leaching composition according to the subject invention provides enhanced or increased efficiency at removing carbonaceous material from gold with limited negative environmental impacts. Additionally, the methods of the subject invention do not require complicated equipment or high energy consumption, and production of the pre-leaching composition can be performed on site, for example, at an ore mine or at a leaching site. In certain embodiments, the subject pre-leaching composition can result in a decreased use of chemical surfactants or other potentially harmful chemicals during processing of gold ore. Furthermore, the reduced-impurity gold materials produced according to the subject invention can be useful for producing more environmentally-friendly, gold products, including, for example, jewelry, electronic components, and heat shielding.

Production of Microbe-Based Products

In certain embodiments, the subject invention provides methods for cultivation of microorganisms and production of microbial metabolites and/or other by-products of microbial growth. The subject invention further utilizes cultivation processes that are suitable for cultivation of microorganisms and production of microbial metabolites on a desired scale. These cultivation processes include, but are not limited to, submerged cultivation/fermentation, solid state fermentation (SSF), and modifications, hybrids and/or combinations thereof.

The microorganisms can be, for example, bacteria, yeast and/or fungi. These microorganisms may be natural, or genetically modified microorganisms. For example, the microorganisms may be transformed with specific genes to exhibit specific characteristics. The microorganisms may also be mutants of a desired strain. As used herein, "mutant" means a strain, genetic variant or subtype of a reference microorganism, wherein the mutant has one or more genetic variations (e.g., a point mutation, missense mutation, nonsense mutation, deletion, duplication, frameshift mutation or repeat expansion) as compared to the reference microorganism. Procedures for making mutants are well known in the microbiological art. For example, UV mutagenesis and nitrosoguanidine are used extensively toward this end.

In certain embodiments, the microbes are capable of producing amphiphilic molecules, enzymes, proteins and/or biopolymers. Microbial biosurfactants, in particular, are produced by a variety of microorganisms such as bacteria, fungi, and yeasts, including, for example, *Agrobacterium* spp. (e.g., *A. radiobacter*); *Arthrobacter* spp.; *Aspergillus* spp.; *Aureobasidium* spp. (e.g., *A. pullulans*); *Azotobacter* (e.g., *A. vinelandii, A. chroococcum*); *Azospirillum* spp. (e.g., *A. brasiliensis*); *Bacillus* spp. (e.g., *B. subtilis, B. amyloliquefaciens, B. pumillus, B. cereus, B. licheniformis, B. firmus, B. laterosporus, B. megaterium*); *Blakeslea; Candida* spp. (e.g., *C. albicans, C. rugosa, C. tropicalis, C. lipolytica, C. torulopsis*); *Clostridium* (e.g., *C. butyricum, C. tyrobutyricum, C. acetobutyricum*, and *C. beijerinckii*); *Campylobacter* spp.; *Cornybacterium* spp.; *Cryptococcus* spp.; *Debaryomyces* spp. (e.g., *D. hansenii*); *Entomophthora* spp.; *Flavobacterium* spp.; *Gordonia* spp.; *Hansenula* spp.; *Hanseniaspora* spp. (e.g., *H. uvarum*); *Issatchenkia* spp; *Kluyveromyces* spp.; *Meyerozyma* spp. (e.g., *M. guilliermondii*); *Mortierella* spp.; *Mycorrhiza* spp.; *Mycobacterium* spp.; *Nocardia* spp.; *Pichia* spp. (e.g., *P. anomala, P. guilliermondii, P. occidentalis, P. kudriavzevii*); *Phycomyces* spp.; *Phythium* spp.; *Pseudomonas* spp. (e.g., *P. aeruginosa, P. chlororaphis, P. putida, P. florescens, P. fragi, P. syringae*); *Pseudozyma* spp. (e.g., *P. aphidis*); *Ralslonia* spp. (e.g., *R. eulropha*); *Rhodococcus* spp. (e.g., *R. erythropolis*); *Rhodospirillum* spp. (e.g., *R. rubrum*); *Rhizobium* spp.; *Rhizopus* spp.; *Saccharomyces* spp. (e.g., *S. cerevisiae, S. boulardii sequela, S. torula*); *Sphingomonas* spp. (e.g., *S. paucimobilis*); *Starmerella* spp. (e.g., *S. bombicola*); *Thraustochytrium* spp.; *Torulopsis* spp.; *Ustilago* spp. (e.g., *U. maydis*); *Wickerhamomyces* spp. (e.g., *W. anomalus*); *Williopsis* spp.; and/or *Zygosaccharomyces* spp. (e.g., *Z. bailii*).

In preferred embodiments, microorganism is a *Starmerella* spp. yeast and/or *Candida* spp. yeast, e.g., *Starmerella* (*Candida*) *bombicola, Candida apicola, Candida batistae, Candida floricola, Candida riodocensis, Candida stellate* and/or *Candida kuoi*. In a specific embodiment, the microorganism is *Starmerella bombicola*, e.g., strain ATCC 22214.

As used herein "fermentation" refers to cultivation or growth of cells under controlled conditions. The growth could be aerobic or anaerobic. In preferred embodiments, the microorganisms are grown using SSF and/or modified versions thereof.

In one embodiment, the subject invention provides materials and methods for the production of biomass (e.g., viable cellular material), extracellular metabolites (e.g. small molecules and excreted proteins), residual nutrients and/or intracellular components (e.g. enzymes and other proteins).

The microbe growth vessel used according to the subject invention can be any fermenter or cultivation reactor for industrial use. In one embodiment, the vessel may have functional controls/sensors or may be connected to functional controls/sensors to measure important factors in the cultivation process, such as pH, oxygen, pressure, temperature, humidity, microbial density and/or metabolite concentration.

In a further embodiment, the vessel may also be able to monitor the growth of microorganisms inside the vessel (e.g., measurement of cell number and growth phases). Alternatively, a daily sample may be taken from the vessel and subjected to enumeration by techniques known in the art, such as dilution plating technique. Dilution plating is a simple technique used to estimate the number of organisms in a sample. The technique can also provide an index by which different environments or treatments can be compared.

In one embodiment, the method includes supplementing the cultivation with a nitrogen source. The nitrogen source can be, for example, potassium nitrate, ammonium nitrate ammonium sulfate, ammonium phosphate, ammonia, urea, and/or ammonium chloride. These nitrogen sources may be used independently or in a combination of two or more.

The method can provide oxygenation to the growing culture. One embodiment utilizes slow motion of air to remove low-oxygen containing air and introduce oxygenated air. In the case of submerged fermentation, the oxygenated air may be ambient air supplemented daily through mechanisms including impellers for mechanical agitation of liquid, and air spargers for supplying bubbles of gas to liquid for dissolution of oxygen into the liquid.

The method can further comprise supplementing the cultivation with a carbon source. The carbon source is typically a carbohydrate, such as glucose, sucrose, lactose, fructose, trehalose, mannose, mannitol, and/or maltose; organic acids such as acetic acid, fumaric acid, citric acid, propionic acid, malic acid, malonic acid, and/or pyruvic acid; alcohols such as ethanol, propanol, butanol, pentanol, hexanol, isobutanol, and/or glycerol; fats and oils such as soybean oil, canola oil, rice bran oil, olive oil, corn oil, sesame oil, and/or linseed oil; etc. These carbon sources may be used independently or in a combination of two or more.

In one embodiment, growth factors and trace nutrients for microorganisms are included in the medium. This is particularly preferred when growing microbes that are incapable of producing all of the vitamins they require. Inorganic nutrients, including trace elements such as iron, zinc, copper, manganese, molybdenum and/or cobalt may also be included in the medium. Furthermore, sources of vitamins, essential amino acids, and microelements can be included, for example, in the form of flours or meals, such as corn flour, or in the form of extracts, such as yeast extract, potato extract, beef extract, soybean extract, banana peel extract, and the like, or in purified forms. Amino acids such as, for example, those useful for biosynthesis of proteins, can also be included.

In one embodiment, inorganic salts may also be included. Usable inorganic salts can be potassium dihydrogen phosphate, dipotassium hydrogen phosphate, disodium hydrogen phosphate, magnesium sulfate, magnesium chloride, iron sulfate, iron chloride, manganese sulfate, manganese chloride, zinc sulfate, lead chloride, copper sulfate, calcium chloride, sodium chloride, calcium carbonate, and/or sodium carbonate. These inorganic salts may be used independently or in a combination of two or more.

In some embodiments, the method for cultivation may further comprise adding additional acids and/or antimicrobials in the medium before, and/or during the cultivation process. Antimicrobial agents or antibiotics are used for protecting the culture against contamination.

Additionally, antifoaming agents may also be added to prevent the formation and/or accumulation of foam during submerged cultivation.

The pH of the mixture should be suitable for the microorganism of interest. Buffers, and pH regulators, such as carbonates and phosphates, may be used to stabilize pH near a preferred value. When metal ions are present in high concentrations, use of a chelating agent in the medium may be necessary.

The microbes can be grown in planktonic form or as biofilm. In the case of biofilm, the vessel may have within it a substrate upon which the microbes can be grown in a biofilm state. The system may also have, for example, the capacity to apply stimuli (such as shear stress) that encourages and/or improves the biofilm growth characteristics.

In one embodiment, the method for cultivation of microorganisms is carried out at about 5° to about 100° C., preferably, 15 to 60° C., more preferably, 25 to 50° C. In a further embodiment, the cultivation may be carried out continuously at a constant temperature. In another embodiment, the cultivation may be subject to changing temperatures.

In one embodiment, the equipment used in the method and cultivation process is sterile. The cultivation equipment such as the reactor/vessel may be separated from, but connected to, a sterilizing unit, e.g., an autoclave. The cultivation equipment may also have a sterilizing unit that sterilizes in situ before starting the inoculation. Air can be sterilized by methods know in the art. For example, the ambient air can pass through at least one filter before being introduced into the vessel. In other embodiments, the medium may be pasteurized or, optionally, no heat at all added, where the use of low water activity and low pH may be exploited to control undesirable bacterial growth.

In one embodiment, the subject invention further provides a method for producing microbial metabolites such as, for example, biosurfactants, enzymes, proteins, ethanol, lactic acid, beta-glucan, peptides, metabolic intermediates, polyunsaturated fatty acid, and lipids, by cultivating a microbe strain of the subject invention under conditions appropriate for growth and metabolite production; and, optionally, purifying the metabolite. The metabolite content produced by the method can be, for example, at least 20%, 30%, 40%, 50%, 60%, 70%, 80%, or 90%.

The microbial growth by-product produced by microorganisms of interest may be retained in the microorganisms or secreted into the growth medium. The medium may contain compounds that stabilize the activity of microbial growth by-product.

The biomass content of the fermentation medium may be, for example, from 5 g/l to 180 g/l or more, or from 10 g/l to 150 g/l.

The cell concentration may be, for example, at least $1\times10^{6}$ to $1\times10^{12}$, $1\times10^{7}$ to $1\times10^{11}$, $1\times10^{8}$ to $1\times10^{10}$, or $1\times10^{9}$ CFU/ml.

The method and equipment for cultivation of microorganisms and production of the microbial by-products can be performed in a batch, a quasi-continuous process, or a continuous process.

In one embodiment, all of the microbial cultivation composition is removed upon the completion of the cultivation (e.g., upon, for example, achieving a desired cell density, or density of a specified metabolite). In this batch procedure, an entirely new batch is initiated upon harvesting of the first batch.

In another embodiment, only a portion of the fermentation product is removed at any one time. In this embodiment, biomass with viable cells, spores, conidia, hyphae and/or mycelia remains in the vessel as an inoculant for a new cultivation batch. The composition that is removed can be a cell-free medium or contain cells, spores, or other reproductive propagules, and/or a combination of thereof. In this manner, a quasi-continuous system is created.

Advantageously, the method does not require complicated equipment or high energy consumption. The microorganisms of interest can be cultivated at small or large scale on site and utilized, even being still-mixed with their media.

In certain embodiments, the subject invention provides a "microbe-based composition," meaning a composition that comprises components that were produced as the result of the growth of microorganisms or other cell cultures. Thus, the microbe-based composition may comprise the microbes themselves and/or by-products of microbial growth. The microbes may be in a vegetative state, in spore form, in mycelial form, in any other form of propagule, or a mixture of these. The microbes may be planktonic or in a biofilm form, or a mixture of both. The by-products of growth may be, for example, metabolites, cell membrane components, expressed proteins, and/or other cellular components. The microbes may be intact or lysed. The microbes may be present in or removed from the composition. The microbes can be present, with broth in which they were grown, in the microbe-based composition. The cells may be present at, for example, a concentration of at least $1\times10^3$, $1\times10^4$, $1\times10^5$, $1\times10^6$, $1\times10^7$, $1\times10^8$, $1\times10^9$, $1\times10^{10}$, $1\times10^{11}$, $1\times10^{12}$, $1\times10^{13}$ or more CFU per milliliter of the composition.

The subject invention further provides "microbe-based products," which are products that are to be applied in practice to achieve a desired result. The microbe-based product can be simply a microbe-based composition harvested from the microbe cultivation process. Alternatively, the microbe-based product may comprise further ingredients that have been added. These additional ingredients can include, for example, stabilizers, acids, buffers, carriers, such as water, salt solutions, or any other appropriate carrier, added nutrients to support further microbial growth, non-nutrient growth enhancers, and/or agents that facilitate tracking of the microbes and/or the composition in the environment to which it is applied. The microbe-based product may also comprise mixtures of microbe-based compositions. The microbe-based product may also comprise one or more components of a microbe-based composition that have been processed in some way such as, but not limited to, filtering, centrifugation, lysing, drying, purification and the like.

One microbe-based product of the subject invention is simply the fermentation medium containing the microorganisms and/or the microbial metabolites produced by the microorganisms and/or any residual nutrients. The product of fermentation may be used directly without extraction or purification. If desired, extraction and purification can be easily achieved using standard extraction and/or purification methods or techniques described in the literature.

The microorganisms in the microbe-based products may be in an active or inactive form, or in the form of vegetative cells, reproductive spores, conidia, mycelia, hyphae, or any other form of microbial propagule. The microbe-based products may also contain a combination of any of these forms of a microorganism.

In one embodiment, different strains of microbe are grown separately and then mixed together to produce the microbe-based product. The microbes can, optionally, be blended with the medium in which they are grown and dried prior to mixing.

The microbe-based products may be used without further stabilization, preservation, and storage. Advantageously, direct usage of these microbe-based products preserves a high viability of the microorganisms, reduces the possibility of contamination from foreign agents and undesirable microorganisms, and maintains the activity of the by-products of microbial growth.

Upon harvesting the microbe-based composition from the growth vessels, further components can be added as the harvested product is placed into containers or otherwise transported for use. The additives can be, for example, buffers, carriers, other microbe-based compositions produced at the same or different facility, viscosity modifiers, preservatives, nutrients for microbe growth, surfactants, emulsifying agents, lubricants, solubility controlling agents, tracking agents, solvents, biocides, antibiotics, pH adjusting agents, chelators, stabilizers, ultra-violet light resistant agents, other microbes and other suitable additives that are customarily used for such preparations.

Optionally, the product can be stored prior to use. The storage time is preferably short. Thus, the storage time may be less than 60 days, 45 days, 30 days, 20 days, 15 days, 10 days, 7 days, 5 days, 3 days, 2 days, 1 day, or 12 hours. In a preferred embodiment, if live cells are present in the product, the product is stored at a cool temperature such as, for example, less than 20° C., 15° C., 10° C., or 5° C. On the other hand, a biosurfactant composition can typically be stored at ambient temperatures.

I claim:

1. A method for extracting an impurity from gold ore, the method comprising:

(i) contacting a pre-leaching composition comprising a biosurfactant with a gold ore for a period of time to yield a mixture comprising a treated gold ore and an impurity, wherein the biosurfactant includes a sophorolipid, the sophorolipid including linear sophorolipid and lactonic sophorolipid and the sophorolipid comprises at least 60% linear sophorolipid; and (ii) separating the impurity and pre-leaching composition containing the gold from the mixture to obtain a reduced-impurity gold-containing material.

2. The method of claim 1, wherein the gold ore comprises carbonaceous material.

3. The method of claim 2, wherein the carbonaceous material comprises elemental carbon, a hydrocarbon, an organic acid, or any combination thereof.

4. The method of claim 1, further comprising crushing, grinding, or pulverizing the gold ore into particles 10 mm or less in diameter prior to step (i).

5. The method of claim 1, wherein the pre-leaching composition is in liquid form, and wherein step (ii) comprises stirring, shaking, and/or bubbling the mixture for a time period of about 1 minute to about 48 hours.

6. The method of claim 1, wherein the impurity and preleaching composition of step (ii) is present in the liquid phase and the gold ore is removed from the liquid.

7. The method of claim 6, wherein the gold ore is in a foam that is formed on the surface of the liquid.

8. The method of claim 1, wherein step (ii) comprises a beneficiation process.

9. The method of claim 8, wherein the beneficiation process is comminution, scrubbing, washing, screening, flotation, hydrocycloning, or any combination thereof.

10. The method of claim 9, wherein a flotation composition comprises a biosurfactant.

11. The method of claim 1, further comprising:

(iii) leaching gold from the reduced-impurity gold-containing material.

12. The method of claim 11, wherein step (iii) comprises applying a leaching solution to the reduced-impurity gold-containing material, optionally, under agitation for a period of time or about 1 hour to 48 hours, wherein the gold ore is contained within a coordination complex that is removed from the impurity.

13. The method of claim 12, wherein the leaching solution comprises a cyanide or a thiosulfate.

14. The method of claim 1, wherein the biosurfactant is a yeast culture comprising the sophorolipid.

15. The method of claim 14, wherein the yeast culture is a *Starmerella* sp. and/or a *Candida* sp. yeast.

16. The method of claim 1, wherein the biosurfactant further includes mannosylerythritol lipid, trehalose lipid, rhamnolipid, or any combination thereof.

17. A method for extracting an impurity from gold ore, the method comprising:

(i) contacting a pre-leaching composition comprising a biosurfactant with a gold ore for a period of time to yield a mixture comprising a treated gold ore and an impurity, wherein the biosurfactant includes a sophorolipid, the sophorolipid including linear sophorolipid and lactonic sophorolipid and the sophorolipid comprises at least 70% linear sophorolipid; and (ii) separating the impurity and pre-leaching composition containing the gold from the mixture to obtain a reduced-impurity gold-containing material.

* * * * *